US008784085B2

(12) United States Patent
Hayashimoto

(10) Patent No.: US 8,784,085 B2
(45) Date of Patent: Jul. 22, 2014

(54) UNIAXIAL ECCENTRIC SCREW PUMP

(75) Inventor: Kazutomo Hayashimoto, Oyama (JP)

(73) Assignee: Furukawa Industrial Machinery Systems Co., Ltd., Tokyo (JP)

( * ) Notice: Subject to any disclaimer, the term of this patent is extended or adjusted under 35 U.S.C. 154(b) by 89 days.

(21) Appl. No.: 13/255,281

(22) PCT Filed: Mar. 4, 2010

(86) PCT No.: PCT/JP2010/053562

§ 371 (c)(1),
(2), (4) Date: Sep. 8, 2011

(87) PCT Pub. No.: WO2010/103993

PCT Pub. Date: Sep. 16, 2010

(65) Prior Publication Data

US 2012/0003112 A1 Jan. 5, 2012

Related U.S. Application Data

(63) Continuation of application No. PCT/JP2009/070734, filed on Dec. 11, 2009.

(30) Foreign Application Priority Data

Mar. 9, 2009 (JP) ..... 2009-054804

(51) Int. Cl.
*F04C 2/107* (2006.01)

(52) U.S. Cl.
CPC ..... *F04C 2/107* (2013.01); *F04C 2/1071* (2013.01); *F04C 2/1076* (2013.01)
USPC ..... 418/166

(58) Field of Classification Search
CPC ..... F04C 2/107; F04C 2/1071; F04C 2/1073; F04C 2/1075; F04C 2/1076; F04C 2/1078; F04C 18/165; F01C 1/101; F01C 1/104
USPC ..... 418/9, 48–51, 102, 160, 161, 162, 166, 418/201.1, 55, 151, 164, 203, 220, 216, 202
See application file for complete search history.

(56) References Cited

U.S. PATENT DOCUMENTS 1,892,217 A * 12/1932 Moineau ..... 74/458
2,505,136 A 4/1950 Moineau (Continued)

FOREIGN PATENT DOCUMENTS

JP 50-049707 A 5/1975
JP 59-153992 A 9/1984

OTHER PUBLICATIONS

Translation of International Preliminary Report on Patentability for PCT/JP2010/053562, mailed Oct. 27, 2011.

(Continued)

*Primary Examiner* — Kenneth Bomberg
*Assistant Examiner* — Jason T Newton
(74) *Attorney, Agent, or Firm* — Young Basile Hanlon & MacFarlane P.C.

(57) ABSTRACT

Disclosed is a uniaxial eccentric screw pump that can prevent the life of a bearing sliding portion from decreasing due to a thrust load applied from a high pressure side to a low pressure side. An external thread-like motor directly coupled with a driving shaft is rotated and eccentrically moved with respect to the axis of a stator to deliver a fluid from an intake side to a discharge side. The pump is provided at an end of the discharge side of the motor and extends toward the discharge side in the axial direction of the stator. The uniaxial eccentric screw pump includes an annular small-diameter portion and a seal member. The seal member is in sliding contact with the outer surface of the small-diameter portion and seals the end of a sliding portion between a self-lubricating bearing on the discharge side and the stator.

2 Claims, 9 Drawing Sheets

(56) References Cited

U.S. PATENT DOCUMENTS

| | | | | | |
|---|---|---|---|---|---|
| 3,139,035 | A | * | 6/1964 | O'Connor | 418/1 |
| 3,216,768 | A | * | 11/1965 | Soeding et al. | 417/203 |
| 3,938,915 | A | | 2/1976 | Olofsson | |
| 3,947,163 | A | | 3/1976 | Olofsson | |
| 5,407,337 | A | * | 4/1995 | Appleby | 418/166 |
| 5,857,842 | A | | 1/1999 | Sheehan | |
| 2007/0253852 | A1 | * | 11/2007 | Weber | 418/45 |

OTHER PUBLICATIONS

European Search Report for Application No. EP10750747 dated Jan. 8, 2014.

* cited by examiner

UNIAXIAL ECCENTRIC SCREW PUMP

CROSS-REFERENCE TO RELATED APPLICATION

This application is a 371 of PCT/JP2010/053562, filed Mar. 4, 2010, and is a continuation of International Application No. PCT/JP2009/070734, filed Dec. 11, 2009.

TECHNICAL FIELD

The present invention relates to a uniaxial eccentric screw pump used for pumping a high viscosity fluid, such as a raw material of food, a chemical raw material, and sewage sludge.

BACKGROUND

Screw pumps include a pump in which a male thread-like rotor is installed in a fixed stator having a female thread-like inner surface, and the rotor is coupled to a driving shaft via a universal joint (e.g., see FIG. 1 of JP 59-153992 A). This uniaxial eccentric screw pump allows the rotor to eccentrically move with respect to a shaft center of the stator while rotating the rotor by rotating its driving shaft, thereby pumping the fluid from its intake side to the discharge side.

Since in the uniaxial eccentric screw pump utilizing the above-mentioned universal joint, however, the stator is secured and the rotor has to rotate under a large reaction force, friction is likely to occur on an inner surface of the stator. In addition, a pumped fluid is liable to be adhered to the universal joint. What is worse, to wash a dead space of the universal joint, without dissolving the universal joint, it is difficult to clean the dead space.

Therefore, there has been developed a uniaxial eccentric screw pump including a male thread-like rotor directly coupled to a driving shaft without the intervention of the universal joint, and a stator having a male thread-like inner surface, which is rotatably supported by a bearing, and axis of rotation of which is placed eccentrically with respect to that of the rotor (e.g., see FIG. 3 of JP 59-153992 A or FIG. 1 of JP 50-49707 A).

SUMMARY

The uniaxial eccentric screw pump of this kind, however, has problems in that the discharge side is subject to high pressure as compared with the intake side, bringing about a thrust load from the discharge side toward the intake side due to a mutual pressure difference. The thrust load imposes a heavy burden on the bearing, leading to the reduction of life of a bearing sliding unit.

In this respect, the uniaxial eccentric screw pump disclosed e.g. in JP 59-153992 A (FIG. 3) merely has a bearing structure supporting both ends of the stator with a relatively small area. In addition, the uniaxial eccentric screw pump disclosed e.g. in JP 50-49707 A (FIG. 1) merely supports both ends of the stator using a normal ball bearing as a bearing supporting the stator. So there is still room for studying the prevention of the reduction in life of the bearing sliding section due to the thrust load applied from a high-pressure side to a low-pressure side.

The present invention is made in view of the aforesaid problems and an object of the present invention is to provide a uniaxial eccentric screw pump capable of preventing the reduction in life of a bearing sliding section due to a thrust load applied from a high-pressure side to a low-pressure side.

To solve the aforementioned problems, there is provided an uniaxial eccentric screw pump including: a male thread-like rotor directly coupled to a driving shaft; a stator rotatably supported via a self-lubricating bearing or a submerged bearing as a sliding bearing and having a female thread-like inner surface having an axis of rotation eccentrically disposed with respect to the axis of rotation of the stator, wherein a fluid is pumped from an intake side to a discharge side by eccentrically moving with respect to a shaft center of the motor while the rotor is rotating, the pump comprising: an annular small-diameter portion provided at an end of the discharge side of the stator compared with an opening of the stator and axially extending toward the discharge side; and a seal member in a sliding contact with a circumferential surface of the small-diameter portion to hermetically seal an end of the sliding bearing and the stator at the discharge side, wherein an external diameter of the annular small-diameter portion is smaller than that of a sliding bearing portion at the intake side of the stator, and an area of the small-diameter portion and an internal area of the small-diameter portion when viewed in an axial direction are larger than an area of the opening when viewed in the axial direction.

The uniaxial eccentric screw pump according to the present invention pumps a fluid from the intake side to the discharge side by eccentrically moving with respect to the shaft center of the stator, while rotating the male thread-like rotor directly coupled to the driving shaft. Thus, since "distorsion" will not occur between the rotor and the stator, as compared with the conventional uniaxial eccentric screw pump with the universal joint, as described above, leakage from the discharge side to the intake side of the pumped fluid can be reduced and high efficiency can be achieved. On that account, it is possible to boost up the pressure to the discharge pressure higher than that attainable in the conventional uniaxial eccentric screw pump.

The uniaxial eccentric screw pump according to the present invention is configured so that the stator rotates with the rotor, and the sliding bearing supporting the stator suffers from a large thrust force exerted from the discharge side. Thereupon, in the uniaxial eccentric screw pump according to the present invention, a small-diameter portion is provided on the discharge side of the stator and the seal member is disposed there. With the small-diameter portion on which the seal member is disposed, the thrust forces are well balanced, thereby maintaining equal to each other the thrust forces applied to the sliding bearing.

That is to say, the uniaxial eccentric screw pump according to the present invention further comprises another annular small-diameter portion provided at the end of the intake side of the stator and axially extending toward the intake side; and another seal member in a sliding contact with the circumferential surface of the small-diameter portion to hermetically seal the end of the sliding portion between the sliding bearing and the stator at the intake side. Since the annular small-diameter portion has an external diameter smaller than that of the bearing sliding section at the intake side of the stator, the pressure-receiving area at the discharge side of the stator to be a high-pressure side may be made smaller than that of the intake side of the stator to be a low-pressure side. Therefore, the pressure applied from the front side in the thrust direction can be decreased with both ends of the stator having the discharge side (high-pressure side) and the intake side (low-pressure side). Accordingly, it is possible to suppress the reduction in life of the bearing sliding section due to the thrust load applied from the high-pressure side to the low-pressure side.

Hereupon, an issue is emerged as to what extent the external diameter of the small-diameter portion is made smaller than that of the bearing sliding section at the intake side of the stator. In other words, setting the external diameter of the small-diameter portion too small beyond a predetermined value generates a discharge resistance of the pump (pressure drop), so the pump efficiency will be degraded. What is more, setting the external diameter of the small-diameter portion too small beyond a predetermined value results in equilibrium (balance) of the thrust load in an opposite direction (the thrust load from the low-pressure side to the high-pressure side).

For this reason, the uniaxial eccentric screw pump according to the present invention is configured such that the external diameter of the small-diameter portion is made smaller than that of the bearing sliding section at the intake side, whereas an area of the small-diameter portion and an internal area of the small-diameter portion when viewed in an axial direction are larger than an area of the opening when viewed in the axial direction, in determining the size of the external diameter of the small-diameter portion.

Thereby, as will be described in detail in the embodiment below, an increase in the discharge pressure of the pump (pressure drop) may be successfully prevented, whereby a decrease in the pump efficiency will not be observed. Additionally, in simultaneous consideration of the thrust force (always constant due to torque of the rotor) that is generated from the sliding friction resistance between the rotor and the stator and exerts forward, equilibrium (balance) of the thrust loads can be kept within the range where the balance does not turn into the opposite direction. This is why the reduction in life of the bearing sliding section due to the thrust load applied from the high-pressure side to the low-pressure side may be prevented with certainty, while keeping pump efficiency.

Hereupon, in the uniaxial eccentric screw pump according to the present invention, it is preferable to further include: another annular small-diameter portion provided at the end of the intake side of the stator and axially extending toward the intake side; and another seal member in a sliding contact with the circumferential surface of the small-diameter portion to hermetically seal the end of the sliding portion between the sliding bearing and the stator at the intake side.

The structure thus configured as above enables blocking of inflow of the pumped fluid in the sliding bearing, as the seal member is also disposed at the intake side of the stator. This separates a liquid delivery section from the sliding bearing to create individually a different space, which avoids committing a fault of cleaning a communication path on which dirt is apt to be left and which shows poor detergency, allowing for cleaning of only a wetted part in the cleaning in place (CIP). Accordingly, this materializes a structure excellent in detergency. Even more, it is possible to prevent mixing of foreign substances, such as abrasion powders or the like, of the sliding bearing in the pumped liquid, and hence reliable sanitation can be enhanced.

Furthermore, in the uniaxial eccentric screw pump according to the present invention, it is preferable to further include: a communication path axially provided along the sliding portion between the sliding bearing and the stator; an inlet formed at the intake side of the seal member so as to communicate with the communication path; and a pumping-out hole formed at the discharge side of the seal member so as to communicate with a discharge opening of the pumped fluid, wherein the pumping-out hole and the inlet are communicated with each other by a flow controller to control a flow rate of the fluid for lubrication that is pumped from the pumping-out hole and supplied from the inlet to the communication path.

Such a structure makes it possible to guide the pumped fluid from the pumping-out hole at the high-pressure side, properly adjust the guided pumped fluid by making use of the flow controller, and supply it to the communication path axially provided to communicate from the inlet to the sliding section. Accordingly, it is suitable, as a measure, for improvement of a lubrication condition between the sliding bearing and the sliding section of the stator.

A uniaxial eccentric screw pump according to the present invention allows suppression of the reduction in life of a bearing sliding section due to a thrust load applied from a high-pressure side to a low-pressure side.

BRIEF DESCRIPTION OF THE DRAWINGS

The various features, advantages and other uses of the present apparatus will become more apparent by referring to the following detailed description and drawings in which:

FIGS. 1A to 1C illustrate a uniaxial eccentric screw pump according to a first embodiment of the present invention, in which FIG. 1A is a side view (the principal parts are illustrated in a cross-sectional view taken along an axis line, and FIG. 1B and FIG. 1C each is a partial end view seen from C in FIG. 1A where an opening of the stator is illustrated by hatching and an internal diameter of a small-diameter portion is illustrated by hatching;

FIGS. 2A and 2B (collectively referred to as FIG. 2) explain a pressure balance corresponding to the first embodiment, with a thrust load F including a thrust load F1 applied from the left to the right and a thrust load F0 applied in an opposite direction (from the right to the left), in which FIG. 2A is a longitudinal sectional view of the uniaxial eccentric screw pump, and FIG. 2B is an arrow view seen from the left direction;

FIGS. 3A and 3B (collectively referred to as FIG. 3) explain a pressure balance corresponding to the first embodiment, with a thrust load F including a thrust load F1 applied from the left to the right and a thrust load F0 applied in an opposite direction (from the right to the left), and in FIG. 3, the phase being shifted by 90 degrees from that shown in FIGS. 2A and 2B, and in which FIG. 3A is a longitudinal sectional view of the uniaxial screw pump and FIG. 3B is an arrow view seen from the left direction;

FIGS. 4A and 4B (collectively referred to as FIG. 4) illustrate a comparative example explaining a pressure balance corresponding to FIG. 1 the first embodiment, showing the case of a thrust load F including a thrust load F0 where a thrust load exerting on the stator is applied from the right to the left and a thrust load F4, in which FIG. 4A is a longitudinal sectional view of the uniaxial eccentric screw pump and FIG. 4B is an arrow view seen from the right direction;

FIGS. 5A to 5C (collectively referred to as FIG. 5) explain a pressure balance corresponding to the first embodiment, showing the case of a thrust load F including a thrust load F2 in which a thrust load F exerting on the stator is applied from the left to the right and a thrust load F0 and a thrust load F3 applied in an opposite direction (from the right to the left), in which FIG. 5A is a longitudinal sectional view of the uniaxial eccentric screw pump, FIG. 5B is an arrow view seen from the right direction and FIG. 5C is an arrow view seen from the left direction;

FIGS. 6A to 6C (collectively referred to as FIG. 6) explain a pressure balance corresponding to the first embodiment, showing the case of a thrust load F including a thrust load F2 in which a thrust load F exerting on the stator is applied from the left to the right and a thrust load F0 and a thrust load F3 applied in an opposite direction (from the right to the left), in which FIG. 6A is a longitudinal sectional view of the uniaxial eccentric screw pump FIG. 6B is an arrow view seen from the left direction and FIG. 6C is an arrow view seen from the right direction;

DETAILED DESCRIPTION

Hereinafter, a description will be made to embodiments of the present invention with reference to the accompanying drawings.

Figure 1A:
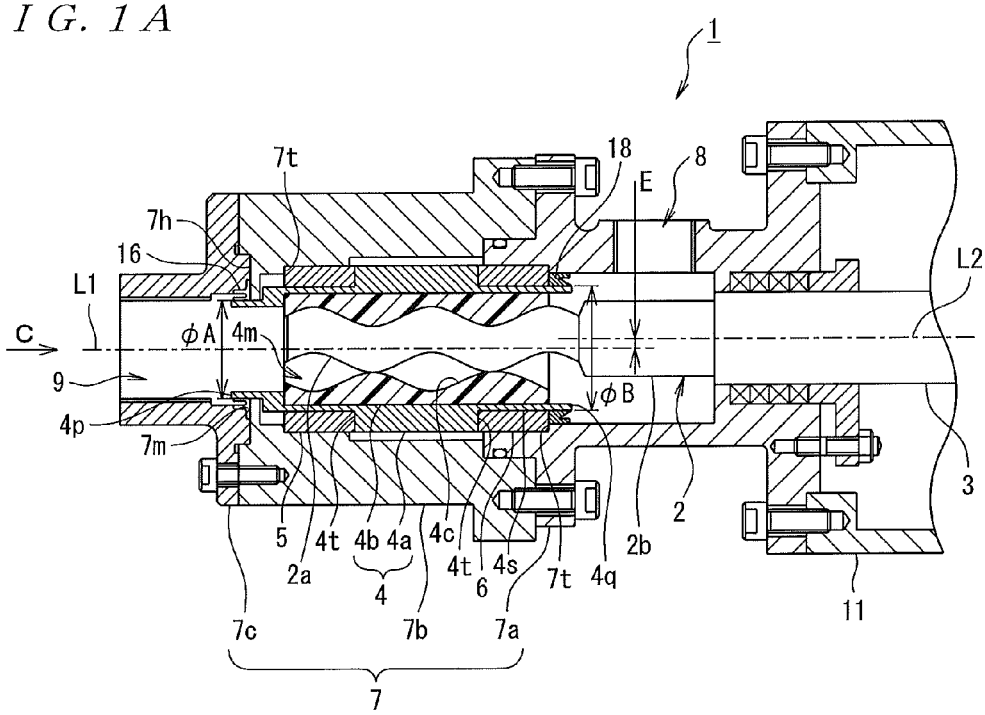

As shown in FIG. 1A, a uniaxial eccentric screw pump 1 includes a bracket 11 for accommodating therein a motor (not shown), the bracket 11 having a housing 7 fitted on a surface at a driving shaft 3 side of the motor. The housing 7 is composed of an intake section 7*a*, a body section 7*b*, and a discharge section 7*c* in this order from the intake side (right side of FIG. 1A). The intake section 7*a* of the housing 7 has an inlet 8 formed to intake a pumped fluid, and the discharge section 7*c* has a discharge opening 9 formed to discharge the pumped fluid. The uniaxial eccentric screw pump 1 includes in the housing 7 a male thread-like rotor 2 and a stator 4 having a female thread-like inner surface.

The rotor 2 is composed of a spiral portion 2*a* at a distal end side and a linear base end portion 2*b*. The base end portion 2*b* is directly coupled with the driving shaft 3 of the motor 10 without the intervention of a universal joint. On the other hand, the spiral portion 2*a* has an elliptical section eccentric with respect to its axis of rotation L2, and is disposed in the stator 4 having the female thread-like inner surface. The axis of rotation L2 of the rotor 2 is arranged so as to be eccentric by a predetermined eccentric amount E with respect to the axis of rotation L1 of the stator 4. In this connection, the stator 4 is composed of a stator external cylinder 4*a* and a stator inner cylinder 4*b* fit in the stator external cylinder 4*a* to rotate in an integral manner. The stator inner cylinder 4*b* is made of a rubber and a spiral portion 4*c* formed inside thereof has a female thread-like pitch twice as large as the spiral portion 2*a* of the rotor 2.

The stator 4 is rotatably supported at its both ends in the housing 7 through annular self-lubricating bearings 5 and 6, each serving as a sliding bearing. A depressed step 7*t* is provided respectively on an inner surface of the intake section 7*a* and the body section 7*b*, each configuring the housing 7. Similarly, a depressed step 4*t* arranged at both ends of which the self-lubricating bearings 5 and 6 are externally fitted is formed respectively on an outer surface of the stator 4 itself. The depressed steps 4*t* and 7*t* restrain the movements of the self-lubricating bearings 5 and 6 in an axial direction.

The uniaxial eccentric screw pump 1 is designed such that when the rotor 2 is rotated by the driving shaft 3, the rotor 2 rotates around an axis of rotation L2. The stator 4 is also driven and rotates in synchronization with the rotation of the rotor 2 around an axis of rotation L1. Accordingly, the pumped fluid can be pumped from the intake 8 to the discharge opening 9.

Herein, the uniaxial eccentric screw pump 1 includes an annular small-diameter portion 4*p* axially extending, at the end of the discharge side of the stator 4, toward the discharge side, and a seal member 16 slidably contacting with the outer surface of the small-diameter portion 4*p*. That is, the uniaxial eccentric screw pump 1 has a structure in which the pressure applied to an outer region of the annular small-diameter portion 4*p* is blocked from the stator side by the seal member 16.

An external diameter ϕA of the small-diameter portion 4*p* is smaller than an external diameter ϕB of an intake-side bearing slidingly contacting portion 4*s* of the stator 4, which is formed as a stepped shape axially projecting up to a position that faces an inner surface of the discharge portion 7*c* of the housing 7.

For that reason, by changing the size of the diameter of the annular small-diameter portion 4*p* of the seal member 16, it is possible to adjust (balance) a thrust force to the stator 4 which is to be determined depending on a pressure-receiving area of the stator 4, thus reducing the thrust force exerted from the high-pressure side to the self-lubricating bearing 6.

Figure 1B:
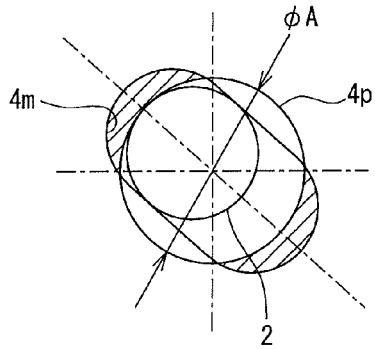
Figure 1C:
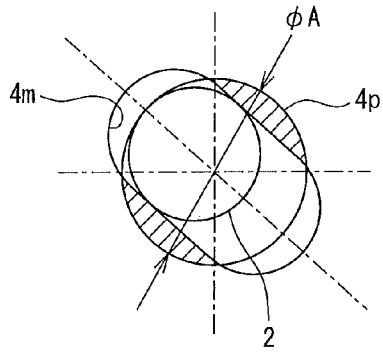

The size of the external diameter ϕA of the small-diameter portion 4*p* is designed such that the pressure-receiving area of the discharge side that is the high-pressure side of the stator 4 is smaller than the pressure-receiving area of the intake side that is the low-pressure side of the stator 4 so as to reduce the pressure applied from the forward (left side) to the both ends of the stator 4 in a thrust direction. More specifically, the small-diameter portion 4*p* is set such that an internal diameter pressure-receiving area becomes larger than an area across which the internal diameter of the stator opening 4*m* is subject to the pump discharge pressure (see a portion drawn by an oblique line in FIG. 1B), when the external diameter ϕA of the small-diameter portion 4*p* is smaller than the external diameter ϕB of the suction-side bearing slidingly contacting portion 4*s* of the stator 4, and when an area, for receiving pump discharge pressure, of the internal diameter of the small-diameter portion 4*p* is called as the internal diameter pressure-receiving area (it is also named as "seal internal diameter pressure-receiving area")(see a portion drawn by an oblique line in FIG. 1C).

Hereafter, a description will be fully made as to how to set a pressure balance condition concerned with the determination of the external diameter ϕA of the small-diameter portion 4*p* appropriately referring to FIG. 2 to FIG. 6.

Figure 2A:
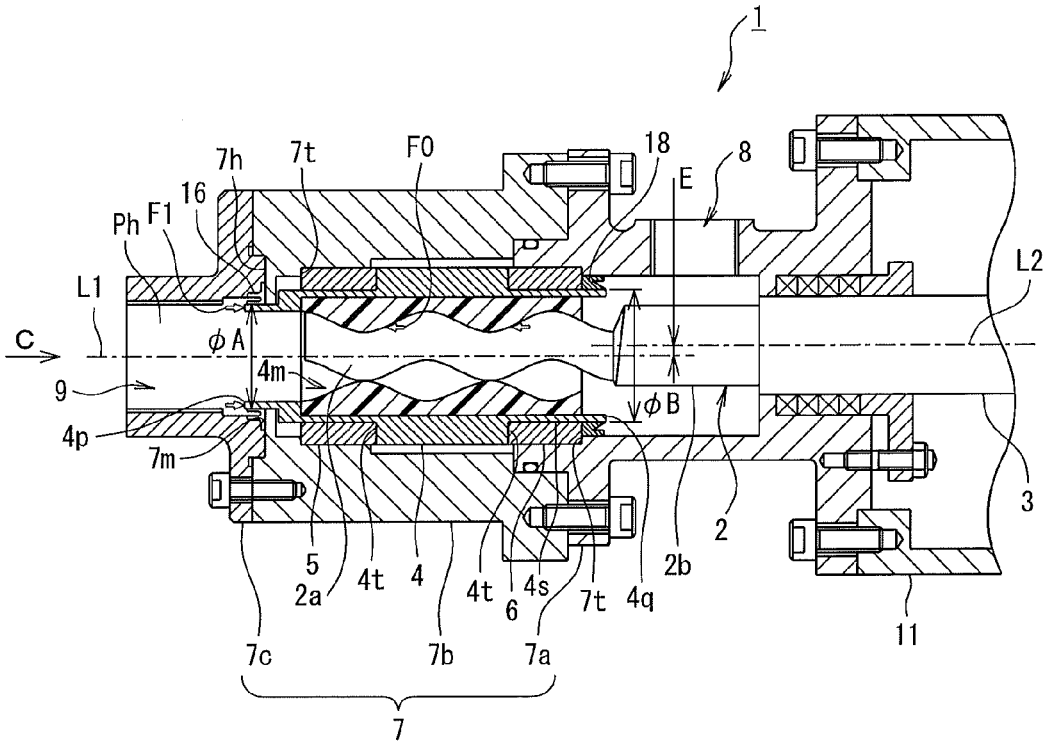
Figure 2B:
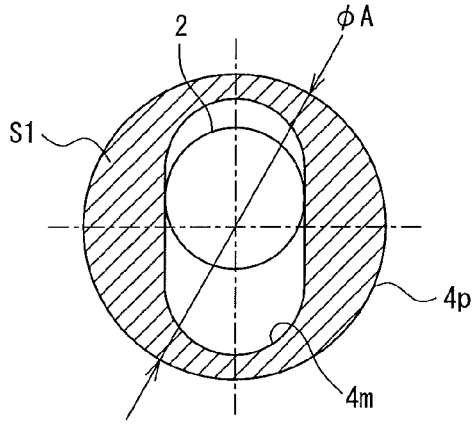
Figure 3A:
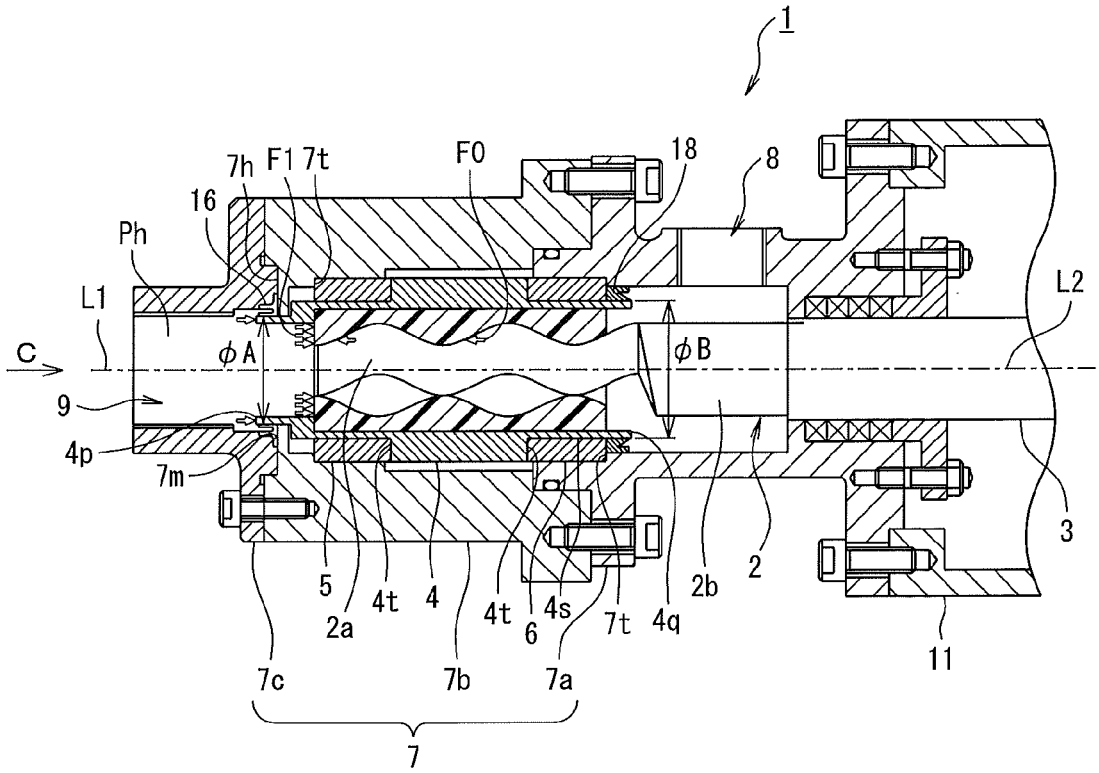
Figure 3B:
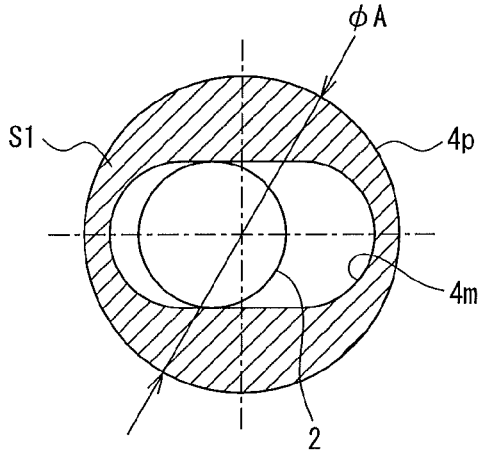

A mention will be firstly made to the case where the internal diameter pressure-receiving area is set to be larger than the area across which the internal diameter of the opening 4*m* of the stator 4 is subject to the pump discharge pressure, by referring to FIG. 2 and FIG. 3. According to one embodiment of the present invention, this example shows a situation where a diameter of the external diameter ϕA of the small-diameter portion 4*p* is larger than the major axis of opening 4*m* of the stator 4. Hereupon, FIG. 3 and FIG. 4 explaining the pressure balance illustrate the case where a thrust load F is applied from the left to the right.

At this moment, the stator 4 receives the thrust force F0 exerted from the right to the left and a thrust force F1 exerted from the left to the right, caused by torque of the stator 2, as seen in FIG. 2 and FIG. 3 (product of the pump discharge pressure Ph and the internal diameter pressure-receiving area S1 at the high-pressure side).

$$F=F1-F0=S1\times Ph-F0$$

$$F1>F0$$

Namely, when the internal diameter pressure-receiving area of the small-diameter portion 4*p* is set to be larger than the area of the opening 4*m* of the stator 4, the stator 4 is pressed from the left to the right, as seen in FIG. 2 and FIG. 3. On that account, a thrust load is applied to the bearing of the stator 4 from the left to the right. As a premise of the present invention, however, the setting dimension itself of the external diameter ϕA of the small-diameter portion 4*p* is originally set to be smaller than the external diameter ϕB of the intake-side bearing slidingly contacting portion 4*s* of the stator 4, as stated above. Consequently, even in this case, at least a thrust load applied from the high-pressure side to the low-pressure side is suppressed.

However, if the setting dimension of the external diameter of the small-diameter portion 4*p* is set too small beyond a range where the loads in the thrust direction are maintained equal to each other (balanced), a thrust load will be applied to the bearing of the stator 4 from the right to the left. Thus, there is a limitation posed on the degree of reducing the setting dimension of the external diameter of the stator 4.

Figure 4A:
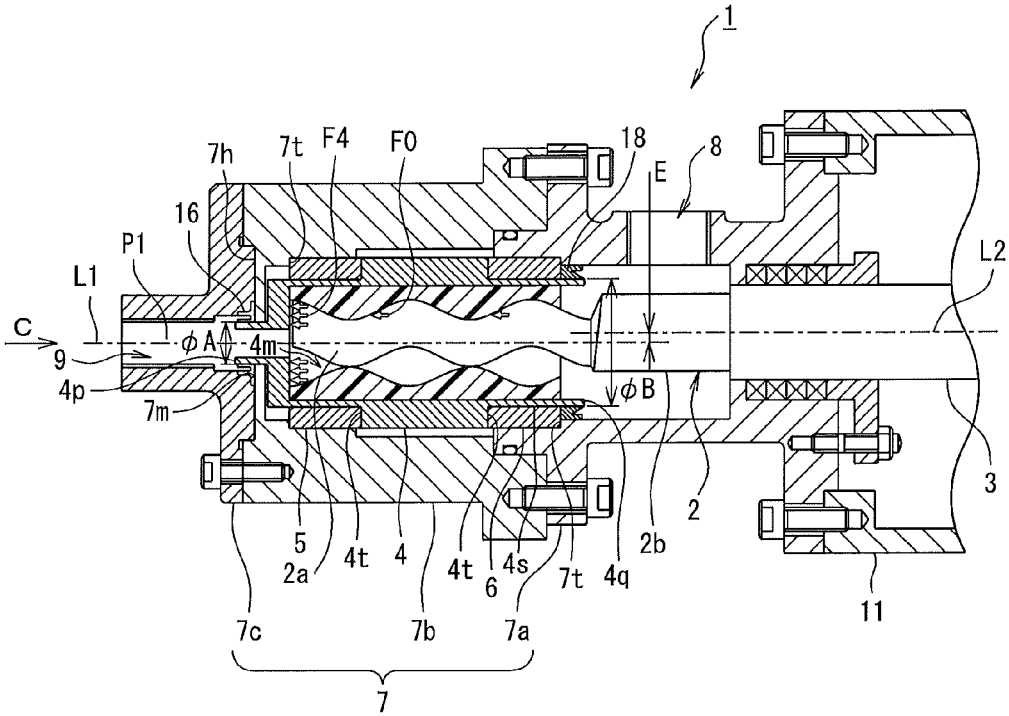
Figure 4B:
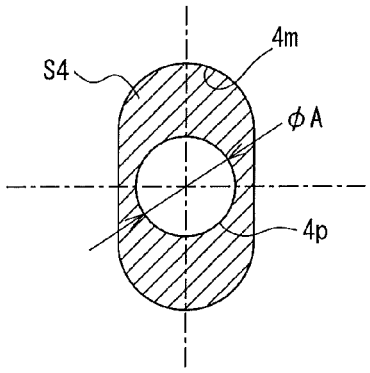

FIG. 4 explaining the pressure balance is an example where the setting dimension of the external diameter of the small-diameter portion 4*p* is set too small. (This is a comparative example beyond the scope of the present invention. In this example, a case is shown where the diameter of the external diameter ϕA of the small-diameter portion 4*p* is smaller than a minor axis of the opening 4*m* of the stator.) This example shows the situation where the thrust load F applied to the stator 4 includes the thrust load F0 exerted from the right to the left and the thrust load F4. At this time, the stator 4 receives the thrust load F0 from the right to the left, and the thrust load F4 from the right to the left paused by the torque of the rotor 2 (product of the pump discharge pressure Ph and the internal diameter pressure-receiving area at the high-pressure side S4), as shown in FIG. 4.

$$F=-F4-F0=-S4\times Ph-F0$$

Accordingly, in this case, the internal diameter pressure-receiving area S4 at the high-pressure side becomes a discharge resistance of the pump, whereas the thrust load F4 becomes a pressure loss. Therefore, if the setting dimension of the external diameter ϕA of the small-diameter portion 4*p* is too small, this will degrade the pump efficiency.

Figure 5A:
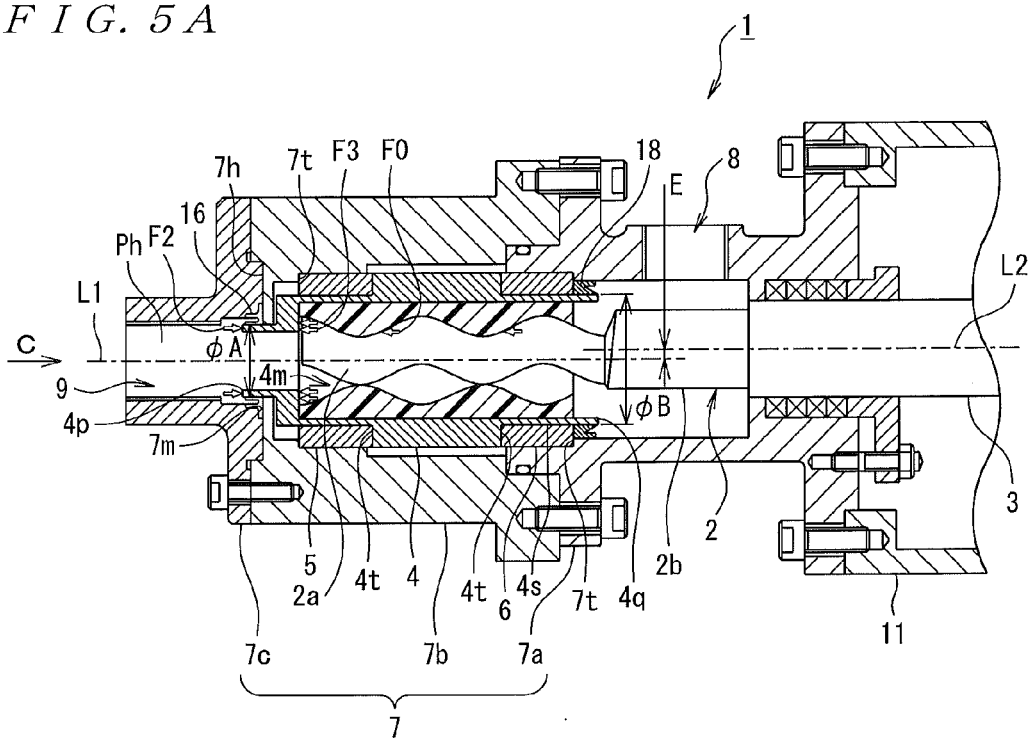
Figure 5B:
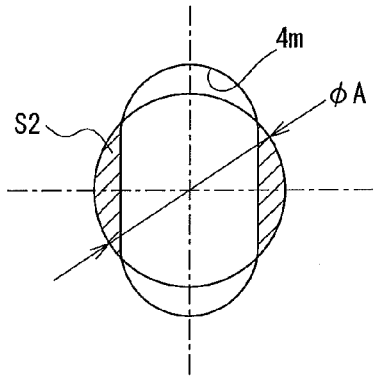
Figure 5C:
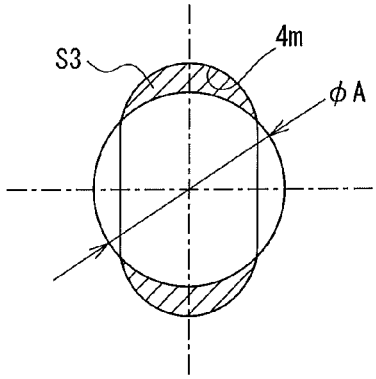
Figure 6A:
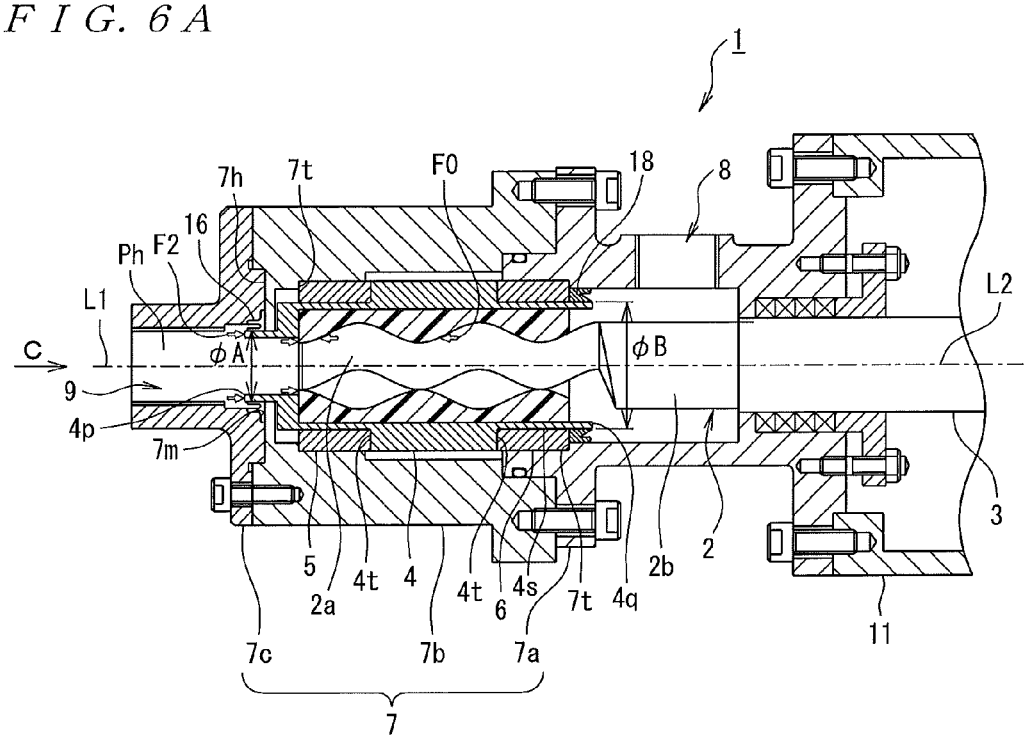
Figure 6B:
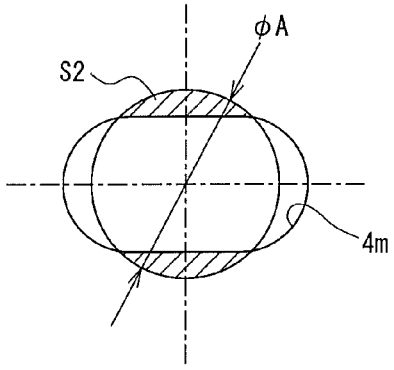
Figure 6C:
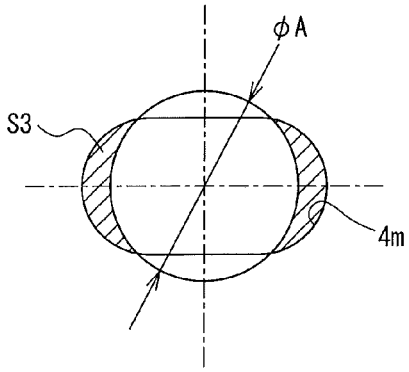

Next, FIG. 5 and FIG. 6 are used in explaining the pressure balance, and show an example where the setting dimension of the external diameter of the small-diameter portion 4*p* is reduced within a predetermined limit (according to one embodiment of the present invention). The example shows the situation where the thrust load applied to the stator 4 includes the thrust load F2 from the left to the right and the thrust load F0 and the thrust load F3 (from the right to the left) in the opposite direction.

On this occasion, the stator 4 receives the thrust load F0 from the right to the left, the thrust load F2 from the left to the right (product of the pump discharge pressure Ph and the internal diameter pressure-receiving area S2 at the high-pressure side), and thrust load F3 from the right to the left (product of the pump discharge load Ph and the internal diameter pressure-receiving area S3 at the low-pressure side), caused by the torque of the stator 4.

$$F=F2-F3-F0=S2\times Ph-S3\times Ph-F0$$

$$F2\geq F0+F3$$

Hereupon, as to the thickness in a radial direction of the small-diameter portion 4*p*, the pump discharge pressure Ph is evenly exerted in the thrust direction (front-back direction, when the discharge is viewed as a reference). Hence, the pressures applying from the right and the left are offset in the thrust direction. When the dimension is set such that the setting dimension of the external diameter of the small-diameter portion 4*p* is made smaller within a predetermined limit, there is no problem in calculating a pressure-receiving area of only the external diameter ϕA (seal internal diameter of the seal member 16) of the small-diameter portion 4*p*, as a reference. That is, setting the seal internal diameter ϕA so that F2=F0+F3 is satisfied achieves the thrust loads exerting on the stator 4 being equal to each other (balanced).

Still more, in the uniaxial eccentric screw pump, the thrust load F0 exerting in the opposite direction to the foregoing thrust force generated with the rotation of the rotor 2, that is the thrust force exerting forward (always constant due to torque of the rotor) is generated from a sliding friction resistance of the rotor 2 and the stator 4. To that end, in the present invention, the thrust force exerting forward is taken into consideration. In sum, in the present invention, the thrust force F0 exerting forward is subtracted at the time of setting the dimension of the internal diameter ϕA of the small-diameter portion 4*p*. For this reason, the smallest diameter of the small-diameter portion 4*p* is determined such that the internal diameter pressure-receiving area is larger than an area, for receiving the pump discharge pressure, of the internal diameter of the opening 4*m* of the stator 4.

In the uniaxial eccentric screw pump 1, an annular brim 7*h* is provided to protrude toward the inside in the radial direction, at the end of the discharge side of the body section 7*b* of the housing 7. The brim 7*h* is formed to protrude in the inner circumferential direction up to a position facing the outer surface of the small-diameter portion 4*p* of the stator 4 so as to have a small gap therebetween.

The seal member 16 is disposed at the discharge side from the end of the sliding portion between the self-lubricating bearing 5 at the discharge side and stator 4, so as to face the outer surface of the small-diameter portion 4*p* of the stator 4, and to hermetically seal the end of the sliding portion.

More particularly, on a surface facing the brim 7*h* where the discharge section 7*c* is provided to protrude in the body section 7*b* of the housing 7, a fitting grove 7*m* having a substantially letter L-shaped cross section is formed thereon. The fitting groove 7*m* is formed to permit the seal member 16 be fit therein so as to be in a-sliding contact with the outer surface of the small-diameter portion 4*p*. The seal member 16 is fitted in the fitting groove 7*m*. As the seal member 16, a lip seal having a lip that protrudes toward the discharge side is used in the example of the present invention.

Furthermore, the uniaxial eccentric screw pump 1 is provided with the annular small-diameter portion 4*q* at an end of the intake side of the stator 4. The small-diameter portion 4*q* is formed by axially extending the intake-side bearing slidingly contacting portion 4*s* (external diameter ϕB) toward the intake side of the stator 4. Then, an annular seal member 18 is disposed to be in a sliding contact with the outer surface of the small-diameter portion 4*q* and to hermetically seal an end of the sliding portion between the self-lubricating bearing 6 and the stator 4.

Operations and effects of the uniaxial eccentric screw pump will next be described.

The uniaxial eccentric screw pump 1 includes: a male thread-like rotor 2 directly coupled with a driving shaft 3; and a stator 4 that is rotatably supported via the self-lubricating bearings 5 and 6 and has a male thread-like internal surface placed eccentrically relative to the axis of rotation L2 of the rotor 2. Since the stator 4 is supported by means of the self-lubricating bearings 5 and 6, the both ends of the stator can be supported with a relatively larger area. Therefore, the structure of the uniaxial eccentric screw pump 1 has less limitation on the liquid nature of pumped fluid than the uniaxial eccentric screw pump where the aforesaid universal joint is utilized, for example, thereby pumping various types of liquid.

As mentioned above, the uniaxial eccentric screw pump 1 includes: the annular small-dimension portion 4*p* formed at an end of the discharge side of the stator 4 and axially extends toward the discharge side; and the seal member 16 in a sliding contact with the outer surface of the small-diameter portion 4*p* and disposed to hermetically seal the self-lubricating bearing 5 of the discharge side and an end of the sliding portion of the stator 4. The external diameter ϕA of the annular small-diameter portion 4*p* is smaller than the external diameter ϕB of the intake-side bearing slidingly contact portion 4*s* of the stator 4, and the inner-diameter portion pressure-receiving area (see a portion illustrated by an oblique line in FIG. 1C) of the small-diameter portion 4*p* is larger than an area of the opening 4*m* of the stator 4 (see a portion illustrated by an oblique line in FIG. 1B). As stated above, this allows a pressure-receiving area at the discharge side of the stator 4 that is a high pressure side to be smaller than that at the intake side of the stator 4 that is a low pressure side, while keeping pump efficiency.

Figure 9:
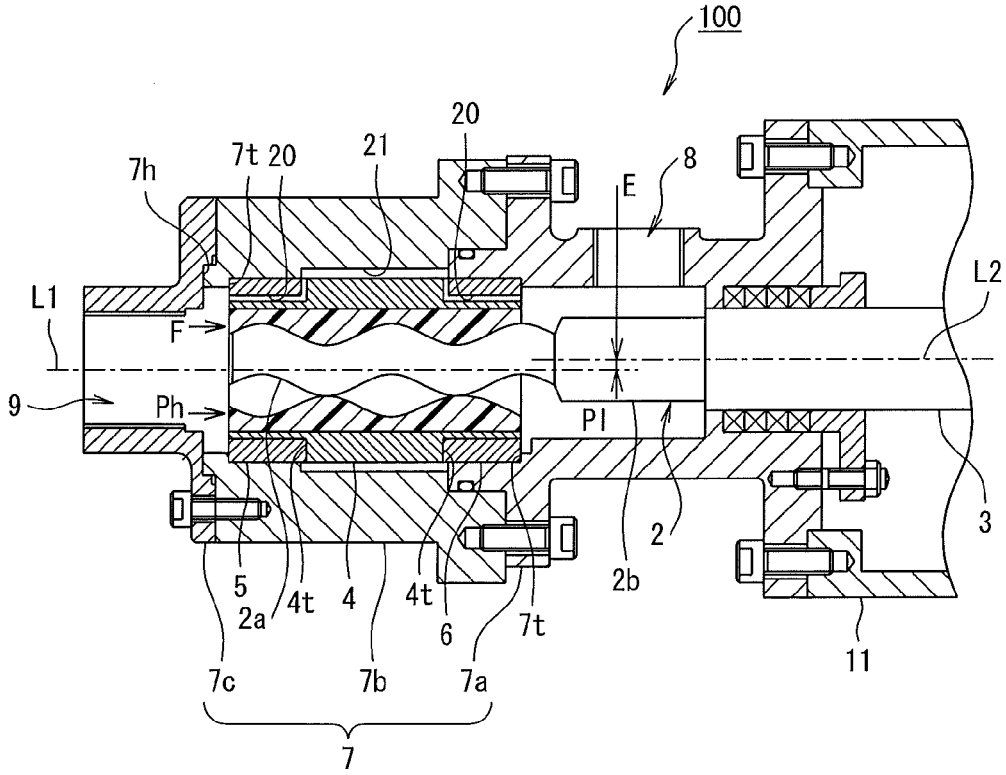
FIG. 9 is a view showing a comparative example where a small-diameter portion of the stator is not formed in the stator and a seal member is not disposed.

Accordingly, as shown in FIG. 9, as compared with the uniaxial eccentric screw pump 100 where the stator is not provided with the small-diameter portion, the pump decreases the pressure applied from the front side in the thrust direction that is applied to the both ends of the stator 4 from the high pressure side (the side indicated by reference numeral Ph in FIG. 9) to the low pressure side (the side indicated by reference numeral PI in FIG. 9). In other words, the small-diameter portion 4*p* in which the seal member 16 is disposed enables keeping of the balance of the thrust forces exerted to the self-lubricating bearing 6. Therefore, this restrains the reduction in life of the bearing sliding section, such as the sliding portions sliding between the self-lubricating bearings 5 and 6 and the stator 4, and the depressed step 7*t*.

Particularly, the uniaxial eccentric screw pump 1 further includes: the annular small-diameter portion 4*q* formed at an end of the intake side of the stator 4 and axially extending toward the intake side; and the seal member 18 in sliding contact with the outer surface of the small-diameter portion 4*q* and disposed to hermetically seal the end of the sliding portion between the self-lubricating bearing 6 at the intake side and the stator 4, thereby blocking inflow of the pumped liquid into the self-lubricating bearing 6. This separates a liquid delivery section from the self-lubricating bearing 6 to create individually a different space, allowing for cleaning of only a wetted part in the cleaning in place (CIP) with no longer cleaning a communication path on which dirt is readily left and shows poor detergency. This materializes a structure excellent in detergency. Even more, mixing of foreign substances, such as abrasion powders, produced in the self-lubrication bearing 6 in the pumped liquid is well prevented, hence possibly providing more reliable sanitation.

It is to be noted that the uniaxial eccentric screw pump 1 according to the present invention is not limited to the aforesaid embodiment, and therefore various modifications may be made without departing from the spirit of the present invention.

For instance, in an example of the embodiment, a description has been made by using the self-lubricating bearings 5 and 6, each as a sliding bearing, without limiting thereto. For example, as a sliding bearing, a submerged bearing such as a ceramic bearing and gum bearing may be used on a condition that a lubricant is supplied to the bearing after a suitable means for preventing the mixing of foreign substances in the bearing is surely taken.

While in the example of the embodiment, e.g., the lip seal is used as the seal member 16, various meniscus seals may be adopted, without limiting thereto.

Further, in the example of the first embodiment, a description has been made by giving an example in which the small-diameter portion 4*q* is provided by axially extending the intake-side bearing slidingly contacting portion 4*s* and the seal member 18 is externally fit onto the small-diameter portion 4*q*. However, the communication path 20 may be provided, for example, as described in the second embodiment of the present invention as illustrated in FIG. 7, in place of the aforesaid small-diameter portion 4*q* and the seal member 18.

Figure 7:
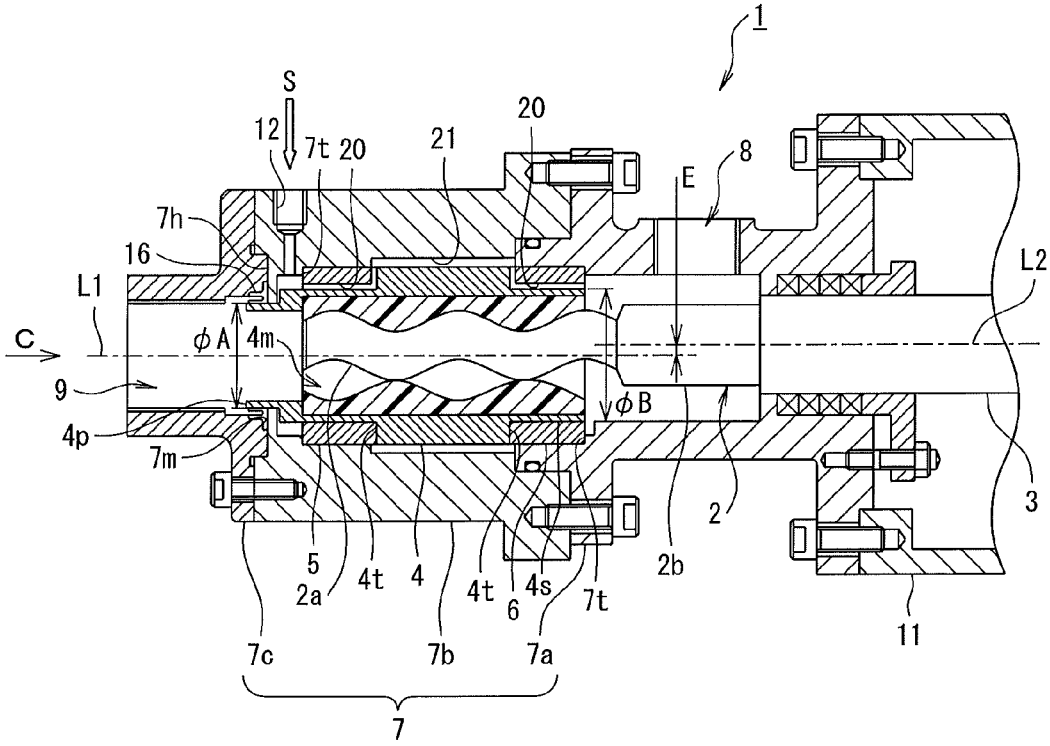
FIG. 7 is an explanation drawing of the uniaxial eccentric screw pump according to a second embodiment of the present invention, taken along a side view and having the principle parts illustrated with a cross-sectional view taken along an axis line.

Concretely, as shown in FIG. 7, the uniaxial eccentric screw pump 1 according to the second embodiment includes the communication path 20 at the sliding portion between each of the self-lubricating bearings 5 and 6 and the stator 4. The communication path 20 can be configured by providing a groove in at least one of the stator 4 and the self-lubricating bearings 5 and 6. However, in the example of the instant embodiment, a substantially letter L-shaped groove is formed on internal surfaces of the self-lubricating bearings 5 and 6 and end surfaces, on the stator 4 side, opposing each other of the self-lubricating bearings 5 and 6 to provide the communication path 20. Furthermore, the large-diameter portion 21 is provided on the inner surface of the body section 7*b* of the housing 7. The large-diameter portion 21 is formed such that the above two communication paths 20 are communicated with each other, thereby ensuring a more stable communication state of the communication path 20 between each of the self-lubricating bearings 5 and 6.

Moreover, in the uniaxial eccentric screw pump 1 according to the second embodiment, an inlet 12 from which (see reference numeral S in FIG. 7) water can be poured from the outside is formed at a position located between the seal member 16 and the self-lubricating bearing 5. This allows the uniaxial screw pump 1 to pour water for lubrication into the communication path 20. In a case where a lubrication condition of the sliding portion between the self-lubrication bearings 5 and 6 and the stator 4 is affected by the liquid nature of the pumped liquid, the pump 1 may improve its lubrication condition.

Figure 8:
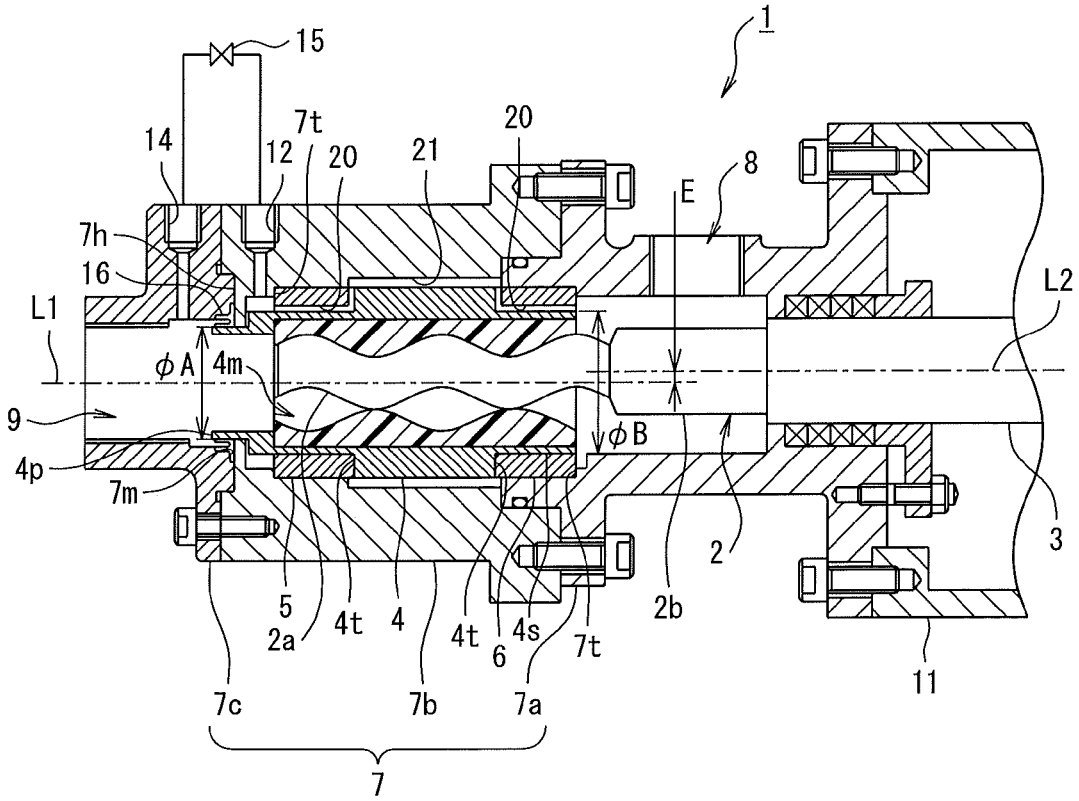
FIG. 8 is a variation of the uniaxial eccentric screw pump of the second embodiment shown in FIG. 7.

As shown in a modification in FIG. 8, a pumping-out hole 14 may be further provided at the discharge side from the seal member 16, in the second embodiment, so as to communicate with the discharge opening 9 of the pumped fluid, and the inlet 12 at the intake side and the pumping-out hole 14 at the discharge side may be communicated with each other through a flow control valve 15. Herein, the flow control valve 15 is a flow controller capable of controlling a flow rate of the fluid for lubrication, which is pumped from the pumping-out hole 14 and supplied from the inlet 12 to the communication path 20.

The structure thus being configured as described above, when lubrication is done using the pumped liquid, enables introducing the pumped liquid at the high-pressure side from the pumping-out hole 14 and supplying it from the inlet 12 to the communication path 20 by adjusting the liquid by means of the flow control valve 15, as a measure for improving the lubrication condition of the sliding portion between the self-lubricating bearings 5 and 6 and the stator 4, depending on the liquid nature of the pumped liquid.

As stated above, the uniaxial eccentric screw pump according to the present invention allows restraining of the reduction in life of the bearing sliding portion caused by the thrust load applied from the high-pressure side to the low-pressure side.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. An uniaxial eccentric screw pump including:

a male thread-like rotor directly coupled to a driving shaft;

a stator rotatably supported via a sliding bearing, the sliding bearing formed of at least one of a self-lubricating bearing or a submerged bearing and the stator having a female thread-like inner surface and an axis of rotation eccentrically disposed with respect to an axis of rotation of the rotor, wherein a fluid is pumped from an intake side to a discharge side while the rotor is rotating and eccentrically moving with respect to a shaft center of the stator, the pump comprising:

a first annular small-diameter portion axially extending toward the discharge side from an end of the discharge side of the stator;

a first seal member in sliding contact with a circumferential surface of the first annular small-diameter portion to hermetically seal an end of the sliding bearing and the stator at the discharge side;

a second annular small-diameter portion axially extending toward the intake side from an end of the intake side of the stator; and a second seal member in sliding contact with a circumferential surface of the second annular small-diameter portion to hermetically seal an end of a sliding portion and the stator at the intake side, wherein an external diameter of the first annular small-diameter portion is smaller than an external diameter of the sliding portion at the intake side of the stator, and an area of the first annular small-diameter portion and an opening of the first annular small-diameter portion, when viewed in an axial direction, is larger than an area of an opening of the discharge side of the stator when viewed in the axial direction.

2. The uniaxial eccentric screw pump according to claim 1, further comprising:

a communication path axially provided along the sliding portion between the sliding bearing and the stator;

an inlet which is formed at the intake side of the first seal member so as to communicate with the communication path, and from which the fluid for lubrication can be poured from outside; and a pumping-out hole formed at the discharge side of the first seal member so as to communicate with a discharge opening of the pumped fluid, wherein the pumping-out hole and the inlet are communicated with each other by a flow controller to control a flow rate of the fluid for lubrication that is pumped from the pumping-out hole and supplied from the inlet to the communication path.

* * * * *